US005090583A

United States Patent [19]

Hoffman et al.

[11] Patent Number: 5,090,583

[45] Date of Patent: Feb. 25, 1992

[54] TAMPER-EVIDENT, TAMPER-RESISTANT CLOSURE

[75] Inventors: Richard W. Hoffman, Chicago; John Kinsley, Crystal Lake; Michael Illenberger, Downers Grove, all of Ill.

[73] Assignee: Magenta Corporation, Chicago, Ill.

[21] Appl. No.: 675,696

[22] Filed: Mar. 27, 1991

[51] Int. Cl.[5] ..... B65D 41/32; B65D 55/16

[52] U.S. Cl. ..... 215/253; 215/250; 215/306; 220/266; 220/265; 220/375

[58] Field of Search ..... 215/306, 250, 258, 235, 215/224, 317, 225; 220/375, 265, 266; 222/538, 543, 545, 562

[56] References Cited

U.S. PATENT DOCUMENTS 3,117,701 1/1964 Stull ..... 222/543
3,192,555 7/1965 Nyden ..... 222/543
3,282,478 11/1966 Russell ..... 222/543
3,974,938 8/1976 Steadman ..... 215/306 X

*Primary Examiner*—Stephen P. Garbe
*Assistant Examiner*—Paul A. Schwarz
*Attorney, Agent, or Firm*—Laff, Whitesel, Conte & Saret

[57] ABSTRACT

A tamper-evident, tamper-resistant closure for an open neck container having a detachable closure cap that is adapted to open and close the dispenser end. A breakaway tether is integrally molded to the closure cap and a first closure ring which fits within the closure cap and around the container neck. A second tether is integrally formed with the closure cap and a second closure ring. The breakaway tether will rupture if this container is tampered with. Also the breakaway tether may be broken when the contents of the container is to be used. The second tether securely maintains the closure cap attached to the main closure.

10 Claims, 2 Drawing Sheets

TAMPER-EVIDENT, TAMPER-RESISTANT CLOSURE

FIELD OF THE INVENTION

This invention relates to a tamper-evident, tamper-resistant closure. More particularly, this invention relates to a tamper-evident, tamper-resistant closure mechanism for eye care products.

BACKGROUND OF THE INVENTION

The public demand for tamper-evident, tamper-resistant closures has increased over recent years. This demand may be partially attributed to the reports of tampering with consumer products. Because of these incidents and related mishaps, retailers and consumers alike have pressured the manufacturers of these products into using tamper resistant mechanisms on the packaging of the product or on the containers themselves. Manufacturers that forego these tamper-proof mechanisms may risk reduced sales due to a consumer fear of possible tampering, or confront retailers that refuse to stock products without tamper-proof mechanisms.

To date, a variety of tamper-evident, tamper-resistant devices are known for products, including, but not limited to, cellophane wrappings, plastic cap members and various cap attachments. One such device is disclosed in Steadman U.S. Pat. No. 3,974,938 wherein a blood bag includes a first flexible seal that may be broken to expose a second seal that serves as a plug mechanism. While the above device provides an effective tamper-proof seal mechanism, it has a more limited application and is expensive because of its relatively complex structure.

Eye care products in particular include a variety of tamper-proof mechanisms that include removable cellophane which encapsulates the box or container that houses the product, break-away tabs that break when the cap is unscrewed, or tear-away plastic that covers the entire cap portion. While these tamper-proof mechanism are effective to a certain extent, they are not without their limitations. First, the above mechanisms are usually not integrally molded to the container or closure element but instead are separate components. Thus, their inclusion on the eye care product involves an additional step in the manufacturing or packaging of the product and substantially increases the cost of the product. Second, the above mechanisms, for the most part, are directed to the packaging of the container as opposed to protecting the actual product itself.

SUMMARY OF THE INVENTION

The present invention, by contrast with the above-mentioned tamper-evident, tamper-resistant mechanisms, is concerned primarily with providing a tamper-evident, tamper-resistant closure mechanism that is tamper-proof and which effectively eliminates the need for additional costly manufacturing steps by molding the tamper evident closure mechanism as a closure element. The molded closure mechanism is cost-effective and is relatively simple to manufacture.

Accordingly, an object of the present invention is to provide a tamper-evident, tamper-resistant closure mechanism for containers.

Another object of the present invention is to provide a tamper-evident, tamper-resistant closure mechanism specifically for eye care products.

Another object of the present invention is to provide a tamper-evident, tamper-resistant one piece closure mechanism for eye care products.

Another object of the present invention is to provide a tamper-evident, tamper-resistant closure mechanism for eye care products that is attached to the container during the manufacturing process.

Yet another object of the present invention is to provide a tamper-evident, tamper-resistant closure mechanism for eye care products that includes means for retaining the cap head to the container after removal of the tamper-evident means.

A further object of the present invention is to provide a tamper-evident, tamper-resistant closure mechanism for eye care products that is inexpensive and simple to manufacture.

The present invention in a preferred embodiment accomplishes the foregoing objects by providing an integrally molded tamper-evident, tamper-resistant closure mechanism for eye care products having a generally cylindrical, hollow closure element with a detachably removable cap that is connected to a first and a preferably diametrically opposed second tether. The first and second tethers are attached to ring elements which are integrally molded with the closure element. The first tether includes a first and second breakable section that may be separated from the closure element by grasping and pulling a pull tab that is integrally formed therewith. The second tether remains permanently attached to the cap and closure element. The first and second breakable sections, when intact with the closure element, indicate that the closure is tamper-free.

The aforementioned embodiment may comprise tamper-evident, tamper-resistant closures that fit onto containers having numerous shapes including, but not limited to, cylinders, spheres, rectangles, squares and cones. Thus, while this invention may encompass a closure element that fits onto containers of many shapes, reference is made herein to only a single structure.

The above, as well as other objects and advantages of the invention, will become apparent from the following detailed description of the preferred embodiment, reference being made to the accompanying drawings.

DETAILED DESCRIPTION OF THE INVENTION

Figure 1:
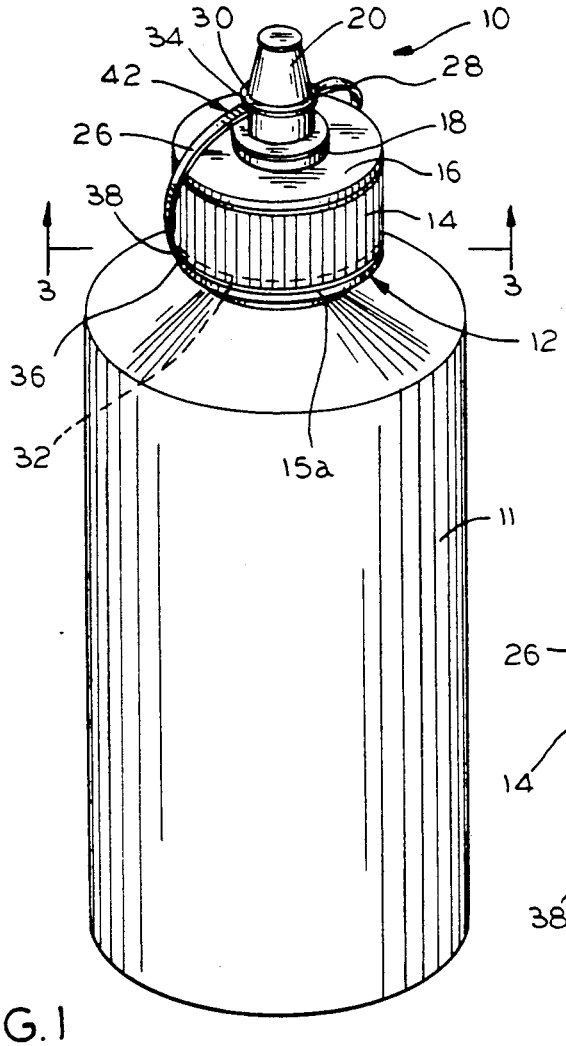
FIG. 1 is a perspective view of the inventive tamper-evident, tamper-resistant closure mechanism as shown assembled on a container.

The invention provides a closure or cap 10 for a container 11 (FIGS. 1–6) having, in part, a hollow, generally cylindrical fitment or shell 12 that includes a skirt 14. The closure 10 is forcibly mounted onto a neck (FIG. 2B) of container 11 by machine and securely remains intact thereon. The cap 10 generally must be forcibly removed by machine or other similar pry means from the container neck 21. The forcible mounting of the closure element is accomplished by providing the container neck 21 (FIG. 2B) with one or more well known circumferential closure tabs 21*a*. The closure tabs extend downwardly at a predetermined angle. The angle of the closure tabs 21*a* are such that the cap 10 is securely mounted on the container 11 and would be very difficult to be manually removed. The inner portion of the cap has a circumferentially extending ridge (not shown) on the inner surface of the skirt to provide a corresponding lock for the cap. The ridge is sized and placed such that when the ca is locked onto the container, the neck tabs 21*a* sandwich the cap ridge. The cap therefore rotates relative to the neck 21 but does not move longitudinally relative to the container.

The cylindrical fitment 12 has a skirt 14. The skirt 14 (FIG. 2 and 2A) has a plurality of parallel longitudinally extending ribs 15. The ribs 15 aid in placing the closure 10 on the container 11. The ribs 15 extend upwardly from a first annular shoulder or ring section 15*a* and are integrally formed with skirt 14. The ribs 15 form a top cylindrical shoulder 17. The shoulder 17 extends radially inwardly to the upper cylindrical extension 19. The cylindrical extension 19 is preferably less than 20% of the length of a rib 15. The cylindrical extension has a generally cylindrical flat top surface 16. Extending upwards from the top surface 16 and generally centrally therefrom is a cylindrical shoulder or rim 18.

The height of the shoulder 18 is less than one-half the length of a rib 15. The shoulder 18 has a cylindrical side wall 18*a* and a flat cylindrical top wall 18*b*. The top wall 18*b* acts as a stop or shoulder rest for a second closure or cap 20. Extending upwards from the wall 18*b* and generally concentric with the wall 18*a* is a dispensing neck 23. Extending from the upper portion of the neck is a frustoconical dispensing end and a snap locking tab 23*a* that is positioned between the dispensing end 24 and the tubular neck 23. The dispensing end 24 has an opening 22 extending therethrough. The opening 22 is in communication with the interior of container 11 when the cap 10 is on the container.

The cap 20 is snap mounted on unthreaded neck 23 and is adapted to cover the access opening 22. Cap 20 covers opening 22 by having internal means that allow for the snap fitting of cap 20 over retainer tab 23*a*. On the lower portion of the cap 20 is an integral annular extension 30. The cap 20 has attached thereto and integrally molded therewith a first attachment means or tether 26 and a second attachment means or tether 28 (see FIG. 3A).

Figure 2:
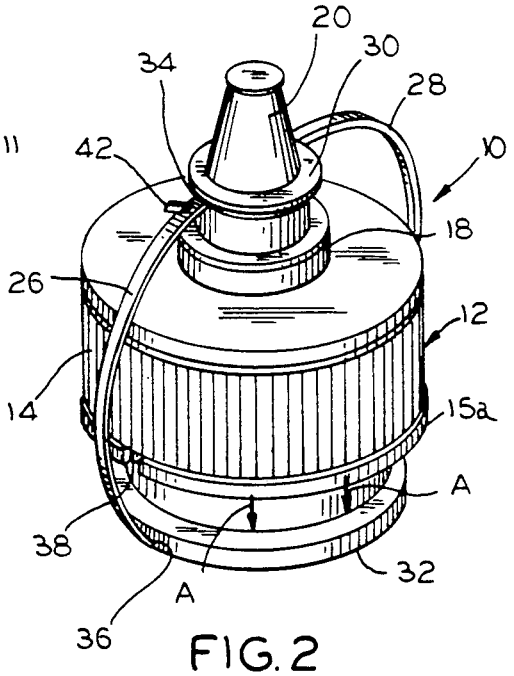
FIG. 2 is a perspective view of the inventive closure mechanism of FIG. 1.
Figure 2A:
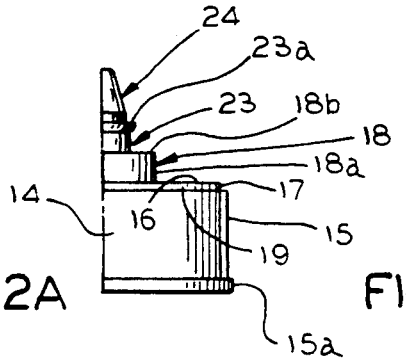
FIG. 2A is a partial cross sectional view of the cap.
Figure 2B:
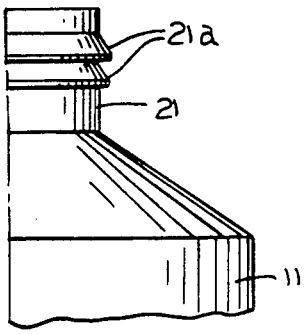
FIG. 2B is a partial cross sectional view of the container.
Figures 3, 3A, 4, 5, 6:
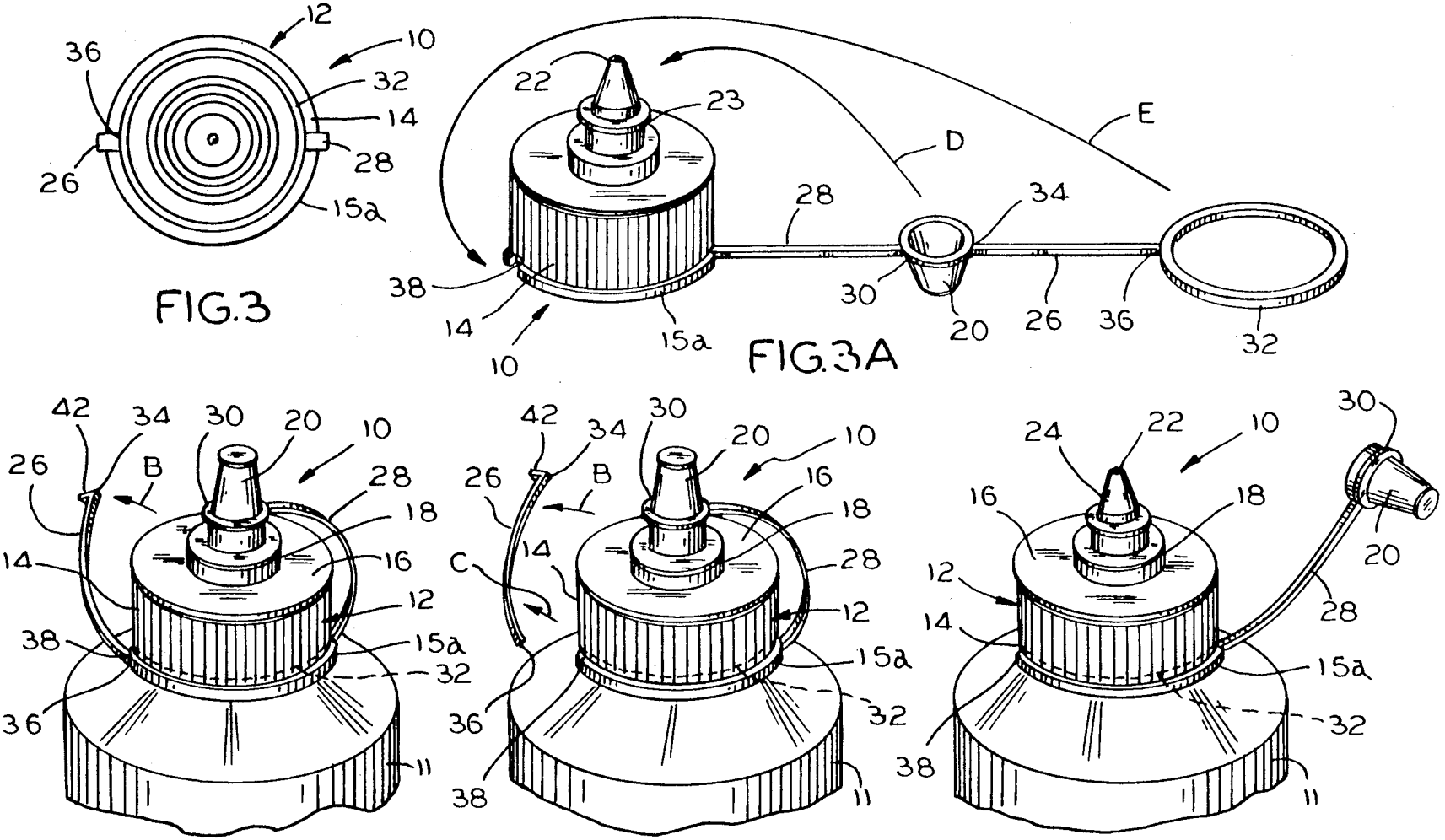
FIG. 3 is a bottom plan view of the inventive closure mechanism of FIG. 1.
FIG. 3A is a perspective view of the inventive closure mechanism of FIG. 1.
FIG. 4 is a perspective view of the inventive closure mechanism of FIG. 1, illustrating it partially detached from the closure element.
FIG. 5 is a perspective view of the inventive closure mechanism of FIG. 1, illustrating it completely detached from the closure element.
FIG. 6 is a perspective view of the inventive closure mechanism of FIGS. 1, 4 and 5, illustrating the cap as detached from the closure element.

First tether 26 is integrally formed at its one end with extension 30 at a first breakable section 34 and is likewise integrally formed at its other end with the ring 32 at a second breakable section 36 (see FIGS. 1, 2 and 3A). Similarly, second tether 28 is integrally molded at its one end to extension 30 and at its other end to ring 15*a*. However, second tether 28 does not include any breakable sections. Both first and second tether 26, 28, are preferably diametrically opposite each other and are connected to extension 30 and first and second rings 32 and 15*a*, respectively. The angle of connection between the tethers 26 and 28 and the extension and the rings is always acute when the cap 20 is on neck 23 and both tethers are attached at both ends to the extension 30 and the first and second rings 15*a* and 32.

The thickness and configuration of the first and second breakable section 34, 36 of the tether 26 are preselected to be less than the thickness of the rest of tether 26. The difference in the thickness enables the tether to break away from the closure element in response to the application of pressure to the first tether. The tether 28 does not have breakable sections and includes a thickness of equal consistency. However, if desired tether 28 may be supplied with breakable sections and then tether 26 would not have breakable sections.

A tab 42 is provided o the tether 26 and integrally molded therewith. In a preferred embodiment, tab 42 is located adjacent to first breakable section 34. Tab 42 provides an easy and convenient means for grasping tether 26 prior to its separation along first and second breakable section 34, 36, as described in greater detail hereinafter. It is, of course, recognized that tab 42 may be located adjacent second breakable section 36.

Extension ring 30 is integrally molded with and extends circumferentially about the external surface of the cap 20 for a predetermined distance above the open end of the cap. This allows the user to more easily snap open cap 20 once tether 26 is removed therefrom.

When the closure 10 is placed on the container, the ring 32 extends circumferentially about the inside surface of the lower section of skirt 14 of closure 10, as shown in FIG. 3. As previously explained, ring 32 is integrally molded to the tether 26. FIG. 2 shows ring 32 as it would appear detached from the interior of the skirt 14 if removed from skirt 14 in the direction of the arrows A. Because the ring 32 is located on the interior surface of skirt 14, and integrally molded to the tether 26, a notch 38 is provided near the lower edge of the skirt 14 or that portion of the skirt that is intersected by the tether 26. The presence of the notch 38 enables the tether 26 to be integrally formed with the ring 32 without interfering with the external shape of closure element 10 (see FIG. 3).

As shown in FIG. 3A, the enclosure 10 is a one-piece molded enclosure. Specifically, the tether 26 is integrally molded to extension 30 of cap 20 and the ring 32. The tether 28 is integrally molded diametrically opposite tether 26 to extension 30 at one end and at its other end molded to the ring 15*a*. Subsequent to the above molding of the tethers, cap 20 is moved in the direction indicated by the arrow D whereupon it is snap mounted on unthreaded neck 23 so that it covers access opening 22. Then, the ring 32 is moved in the same direction and continues as indicated by the arrow E and is snapped into the interior of skirt 14. The tether 26 extends through notch 38 so that the ring 32 will not interfere with the external shape of closure element 10. After cap 20 and the ring 32 have been snapped into their proper positions, closure element 10 is then forcibly mounted onto the neck of container 11.

FIGS. 4 through 6 illustrate the method of removing the tether 26 from closure element 10 so that cap 20 may uncover opening 22 of dispensing element 24. First, tab 42 is manually pulled which causes the tether 26 to initially separate from extension 30 along first breakable section 34, in the direction indicated by arrow B in FIGS. 4–5. Continued manual pulling on tab 42 then causes tether 26 to eventually separate from ring 32 along second breakable section 36, as indicated by arrow C in FIG. 5. In the preferred embodiment, tether 26 is detached completely from ring 32. In another embodiment, tether 26 may be left attached to ring 32. After tether 26 has been detached from first and second breakable section 34, 36, respectively, it may be discarded. Subsequent to the complete removal of tether 26 from closure element 10, cap 20 is then adapted to be removed from neck 18 for a certain distance to uncover opening 22, as shown in FIG. 6. However, even though cap 20 is removable from opening 22, it still remains connected to closure element 10 by tether 28.

The materials from which the closure element 10 are constructed could be a myriad of materials, including polyvinyl chloride, plastic, or any other materials that are flexible and sturdy. The strength and material of the first tether is selected to provide sufficient strength to maintain a cohesive structure until separation of the first tether from the closure element. The strength of the second tether and the remaining components of closure element 10 are sufficiently strong so that manual manipulation while covering an uncovering the dispenser 20 will not cause it to prematurely rupture.

The closure element 10 has not been described in terms of approximate measurements, as it should be understood that the size of the element 10 may vary according to need or to the size of the corresponding container.

Therefore, it should be recognized that, while the invention has been described in relation to a preferred embodiment thereof, those skilled in the art may develop a wide variation of structural details without departing from the principles of the invention. Therefore, the appended claims are to be construed to cover all equivalents falling within the true scope and spirit of the invention.

The invention claimed is:

1. A tamper-evident, tamper-resistant closure for an access opening to a container comprising:

said closure having an open end and a dispensing end, said open end being adapted to close said container opening;

a detachable closure cap being adapted to open and close said dispenser end;

a first holding element that circumferentially extends around the interior of a closure shell;

a second holding element that circumferentially extends around the exterior of the closure shell;

a first attachment means that is connected to the cap and the first holding element;

a second attachment means that is connected to the cap and the second holding element;

a notch means that is provided adjacent a bottom portion of the closure shell and which is intersected by the first attachment means; and at least one breakable means for separating the first or second attachment means from the closure.

2. The tamper-evident, tamper-resistant closure of claim 1 wherein the first holding element is a ring.

3. The tamper-evident, tamper-resistant closure of claim 1 wherein the second holding element is an annular ring section formed on the lower portion of the shell.

4. The tamper-evident, tamper-resistant closure of claim 1 wherein the closure is a one-piece molded plastic closure and the first and second attachment means are attached to the cap diametrically opposite each other.

5. The tamper-evident, tamper-resistant closure of claim 4 wherein said notch means is formed in the closure shell diametrically opposite where said second attachment is connected to said shell, whereby said notch means accommodates said first attachment means when the closure is mounted on said container.

6. The tamper-evident, tamper-resistant closure of claim 4 wherein the breakable means are first and second breakable sections along the first or second attachment means.

7. The tamper-evident, tamper-resistant closure mechanism of claim 6 wherein the breakable means is on said first attachment means and includes a tab connected to the first attachment means.

8. A tamper-evident, tamper-resistant one-piece molded plastic closure for an access opening to a container having an unthreaded neck that defines a container mouth, comprising:

a closure body that includes a generally cylindrical shell having an inner surface that is adapted to be press fitted onto said container neck;

said closure body having a frusto-conical dispenser end extending from a top portion thereof;

a detachable closure cap being sized to snap fit onto the dispenser to close said dispenser and to open said dispenser with normal finger or thumb pressure;

a first ring sized to circumferentially extend around the inside surface of the closure body shell and over said container neck;

a second ring circumferentially extending around the lower external surface of the shell;

a first tether that extends from said first ring to said detachable closure cap at an acute angle with the closure cap and with said first ring;

a second tether that extends from said detachable closure cap diametrically opposed to the first tether to the second ring, said first or second tether having a first and second breakable section thereon;

a notch means that is provided adjacent a bottom portion of the closure shell and which is intersected by the first tether; and a tab means on said first or second tether, said tab providing a means for separating said first or second tether from the closure element along said first and second breakable sections.

9. The tamper-evident, tamper-resistant closure mechanism of claim 8 wherein said first and second breakable sections are on said first tether adjacent the first ring and said detachable cap, said tab is on said first tether, wherein subsequent to the separation of the first tether from the closure element said detachable cap remains connected to said closure element by said second tether, said second ring being an integral part of said closure body, and said notch means formed in said second ring diametrically opposite where said second tether is attached, said notch means being sized to accommodate said first tether when said first ring is located inside said closure body.

10. The tamper-evident, tamper-resistant closure mechanism of claim 9 wherein said container is for eye products.

* * * * *